US009227218B1

(12) United States Patent
Lin

(10) Patent No.: US 9,227,218 B1
(45) Date of Patent: Jan. 5, 2016

(54) DOUBLE-SEALANT TUBE STRUCTURE FOR CAULKING GUN

(71) Applicant: FASTFIX-IT ENTERPRISE CO., LTD., Kaohsiung (TW)

(72) Inventor: Ivy Lin, Kaohsiung (TW)

(73) Assignee: Fastfix-it Enterprise Co., Ltd., Kaohsiung (TW)

( * ) Notice: Subject to any disclaimer, the term of this patent is extended or adjusted under 35 U.S.C. 154(b) by 5 days.

(21) Appl. No.: 14/339,490

(22) Filed: Jul. 24, 2014

(51) Int. Cl.

| | |
|---|---|
| ***B05C 17/01*** | (2006.01) |
| ***B05C 17/005*** | (2006.01) |
| *B65D 83/00* | (2006.01) |
| *B65D 81/32* | (2006.01) |

(52) U.S. Cl.
CPC ..... *B05C 17/0106* (2013.01); *B05C 17/00596* (2013.01); *B05C 17/00553* (2013.01); *B05C 17/00559* (2013.01); *B65D 81/325* (2013.01); *B65D 81/3255* (2013.01); *B65D 83/0033* (2013.01)

(58) Field of Classification Search
CPC ..... B65D 81/325; B65D 81/3255; B65D 83/0033; B65D 41/02; B65D 25/48; B65D 85/72; B05C 17/00559; B05C 17/00553; B05C 17/0106; B05C 17/00596
See application file for complete search history.

(56) References Cited

U.S. PATENT DOCUMENTS

2012/0104030 A1* 5/2012 Springhorn ..... B05C 17/00553 222/1
2014/0203042 A1* 7/2014 Tsai ..... B65D 83/0033 222/80

FOREIGN PATENT DOCUMENTS

EP 2447184 A1 * 5/2012 ..... B05C 17/00553
WO WO 0117869 A1 * 3/2001 ..... B65B 3/14

* cited by examiner

*Primary Examiner* — Frederick C Nicolas
(74) *Attorney, Agent, or Firm* — Alan D. Kamrath; Kamrath IP Lawfirm, P.A.

(57) ABSTRACT

A double-sealant tube structure for a caulking gun includes a container (10), a first feeder (20), a second feeder (30), and a pushing member (40). The container has an interior provided with a separation plate (12). The pushing member is provided with two first thrust portions (42) corresponding to the first feeder and a second thrust portion (41) corresponding to the second feeder. The pushing member is further provided with two cutting blades (43) each intersecting the separation plate of the container. Thus, when the pushing member pushes the first feeder and the second feeder, the separation plate is cut by the cutting blades to allow the pushing member to move forward.

5 Claims, 4 Drawing Sheets

DOUBLE-SEALANT TUBE STRUCTURE FOR CAULKING GUN

BACKGROUND OF THE INVENTION

1. Field of the Invention

The present invention relates to a sealant tube structure and, more particularly, to a double-sealant tube structure for a caulking gun.

2. Description of the Related Art

A conventional double-sealant tube structure comprises a first tube, a second tube separated from the first tube, and a common spout located and connected between the first tube and the second tube. The first tube contains a main sealant (such as a synthetic resin), and the second tube contains a secondary sealant (such as a hardening agent). The conventional double-sealant tube structure is placed in a caulking gun. When the caulking gun is started, the piston release of the caulking gun gradually pushes the first tube and the second tube to compress the main sealant and the secondary sealant, so that the main sealant and the secondary sealant are compressed toward and squeezed outward from the common spout. However, it is necessary to provide a specially designed caulking gun to operate the conventional double-sealant tube structure so that the conventional double-sealant tube structure is not available for a traditional silicone caulking gun, thereby limiting the versatility of the conventional double-sealant tube structure.

BRIEF SUMMARY OF THE INVENTION

In accordance with the present invention, there is provided a double-sealant tube structure comprising a container, a first feeder, a second feeder, and a pushing member. The container has an end provided with a spout. The spout of the container has an interior provided with a dividing plate. The container has an interior provided with a separation plate. The first feeder is mounted in the main space of the container. The second feeder is mounted in the secondary space of the container. The pushing member is provided with two first thrust portions corresponding to the first feeder and a second thrust portion corresponding to the second feeder. The pushing member is further provided with two cutting blades each located between one of the two first thrust portions and the second thrust portion. Each of the cutting blades of the pushing member is perpendicular to and intersects the separation plate of the container. The pushing member is further provided with an arcuate pressing edge to press the separation plate toward an inner wall of the container when the separation plate is cut by the cutting blades of the pushing member. Thus, when the pushing member pushes the first feeder and the second feeder, the separation plate is cut by the cutting blades to allow the pushing member to move forward.

According to the primary advantage of the present invention, the container is directly placed into a caulking gun so that the user can use the double-sealant tube structure easily and conveniently.

According to another advantage of the present invention, the main sealant and the secondary sealant are separated exactly during storage and usage.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
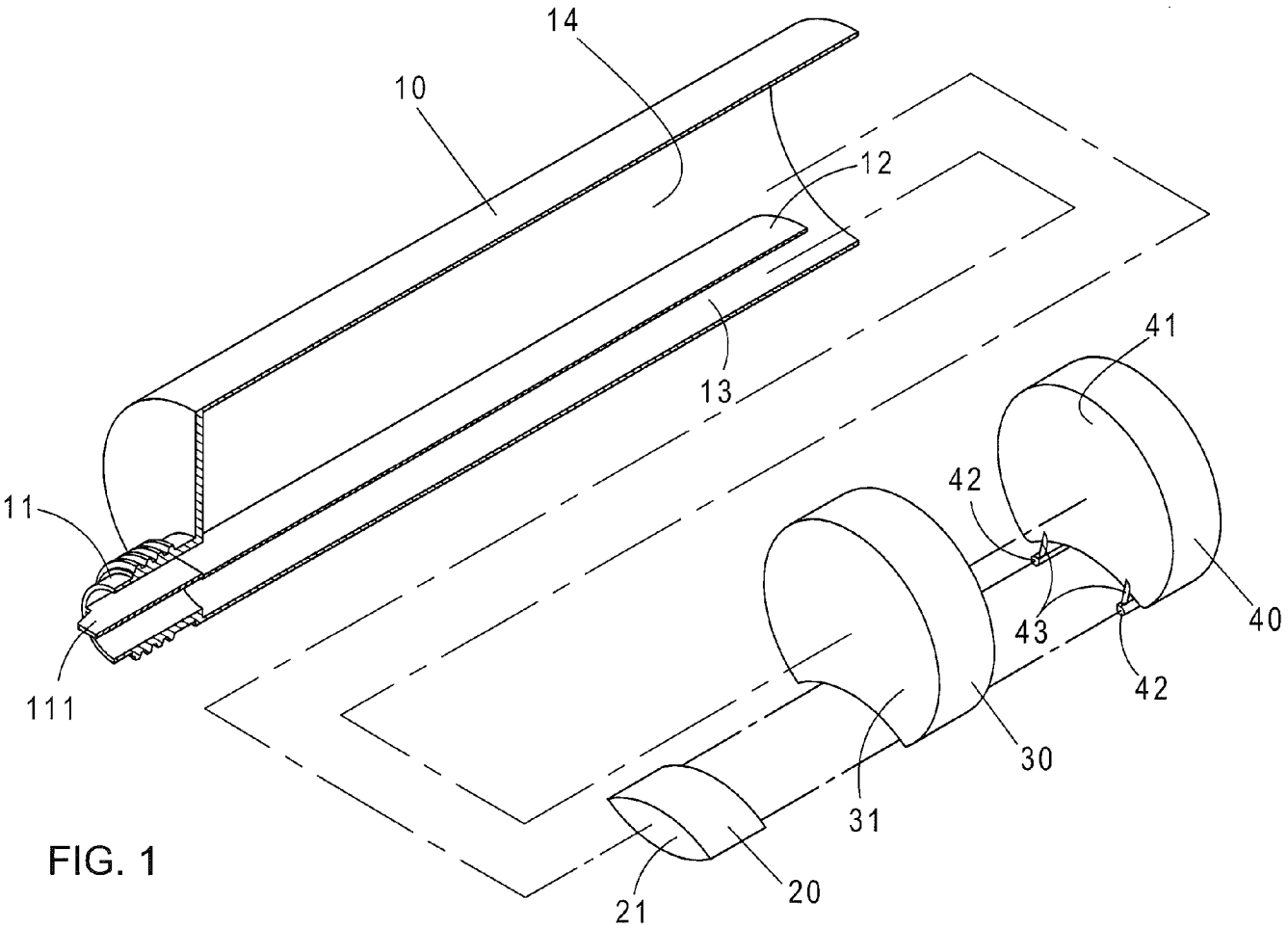
FIG. 1 is an exploded perspective view of a double-sealant tube structure for a caulking gun in accordance with the preferred embodiment of the present invention.
Figure 2:
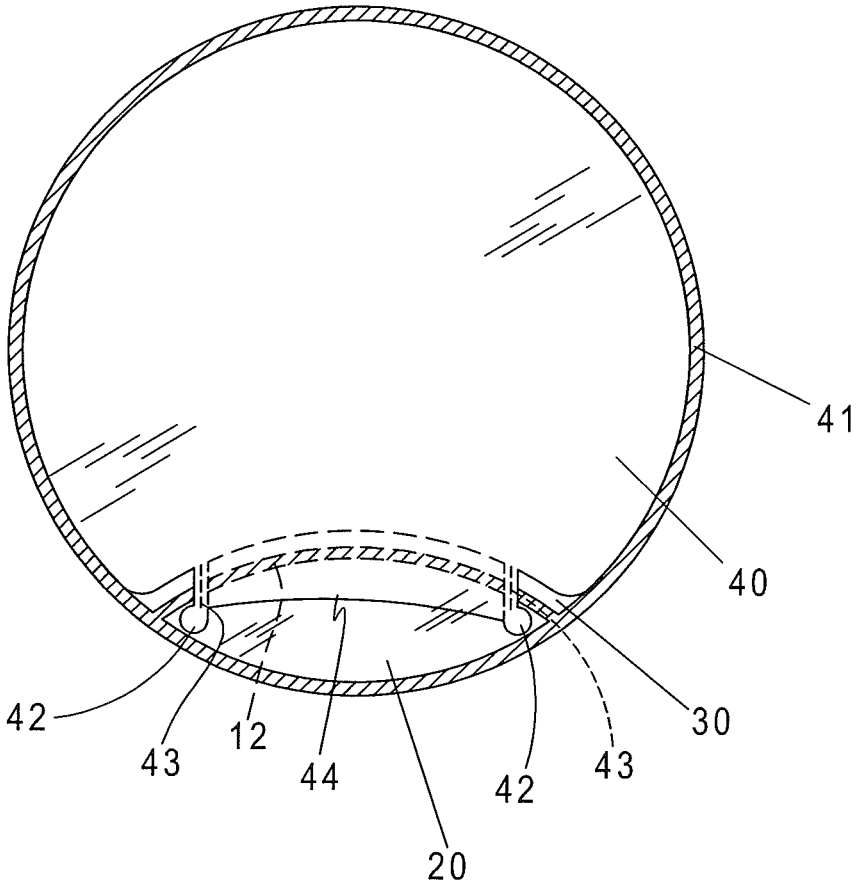
FIG. 2 is a cross-sectional assembly view of the double-sealant tube structure for a caulking gun as shown in FIG. 1.
Figure 3:
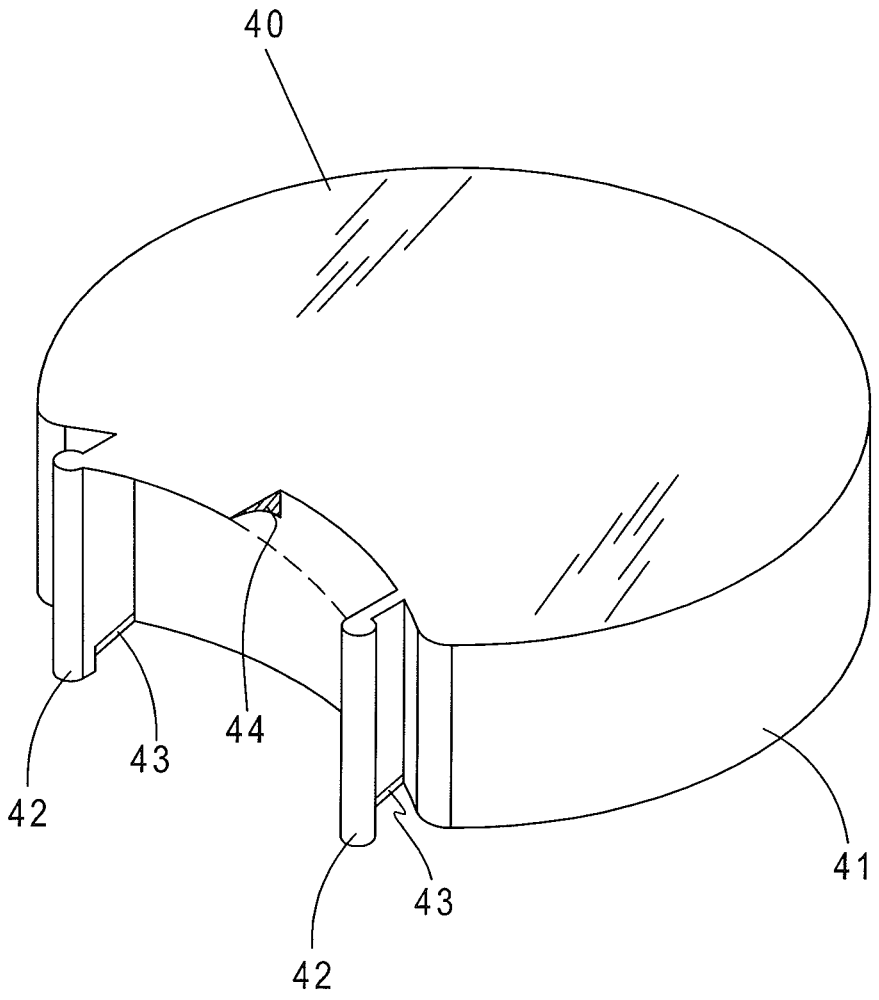
FIG. 3 is a perspective view of a pushing member of the double-sealant tube structure for a caulking gun in accordance with the preferred embodiment of the present invention.

Referring to the drawings and initially to FIGS. 1-3, a double-sealant tube structure for a caulking gun in accordance with the preferred embodiment of the present invention comprises a container 10, a first feeder 20, a second feeder 30, and a pushing member 40.

The container 10 is a tube and has an end provided with a spout 11. The spout 11 of the container 10 has an interior provided with a dividing plate 111. The container 10 has an interior provided with a separation plate 12 which separates an inner space of the container 10 into a main space 13 and a secondary space 14 separated from the main space 13. The separation plate 12 of the container 10 extends from the dividing plate 111 of the spout 11 to an open end of the container 10. Preferably, the container 10 has a size the same as that of a one-sealant (such as silicone gel) tube.

The first feeder 20 is mounted in the main space 13 of the container 10 and has a cross-sectional shape corresponding to that of an inner wall of the main space 13. Preferably, the first feeder 20 has a cylindrical shape and has a push face 21.

The second feeder 30 is mounted in the secondary space 14 of the container 10 and has a cross-sectional shape corresponding to that of an inner wall of the secondary space 14. The second feeder 30 is juxtaposed to the first feeder 20. Preferably, an annular rib (not shown) is formed on an outer periphery of the first feeder 20 and the second feeder 30 to enhance the closing effect. Preferably, the second feeder 30 has a cylindrical shape and has a push face 31.

The pushing member 40 is provided with two first thrust portions 42 corresponding to the first feeder 20 and a second thrust portion 41 corresponding to the second feeder 30. The pushing member 40 is further provided with two cutting blades 43 each located between one of the two first thrust portions 42 and the second thrust portion 41. Each of the cutting blades 43 of the pushing member 40 is perpendicular to and intersects the separation plate 12 of the container 10. The pushing member 40 is further provided with an arcuate pressing edge 44 to press the separation plate 12 toward an inner wall of the container 10 when the separation plate 12 is cut by the cutting blades 43 of the pushing member 40. Thus, when the pushing member 40 is driven by a caulking gun and pushes the first feeder 20 and the second feeder 30, the separation plate 12 is cut by the cutting blades 43 to allow the pushing member 40 to move forward.

Figure 4:
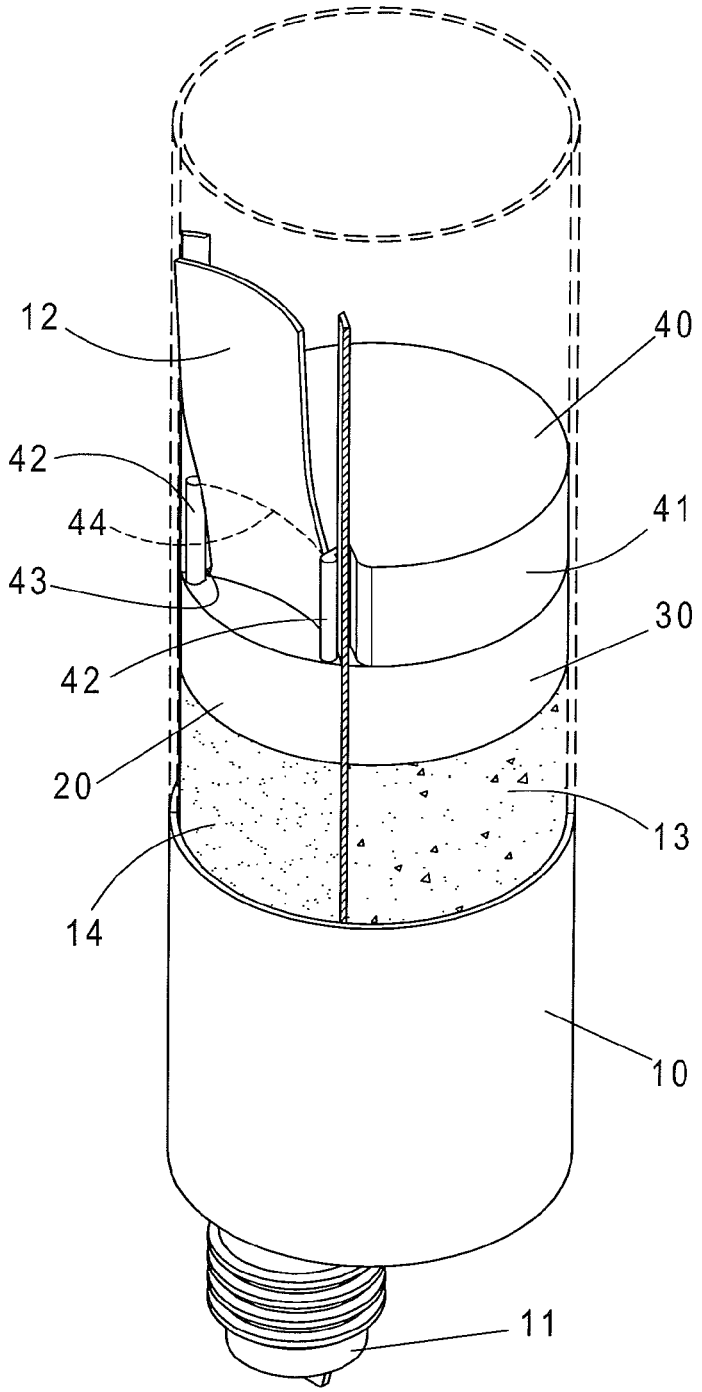
FIG. 4 is a schematic perspective operational view of the double-sealant tube structure for a caulking gun as shown in FIG. 1.

In operation, referring to FIG. 4 with reference to FIGS. 1-3, the main space 13 of the container 10 contains a main sealant (such as a synthetic resin), and the secondary space 14 of the container 10 contains a secondary sealant (such as a hardening agent). The first feeder 20 is mounted in the main space 13 of the container 10 and abuts the main sealant, and the second feeder 30 is mounted in the secondary space 14 of the container 10 and abuts the secondary sealant. The first thrust portions 42 of the pushing member 40 abuts the first feeder 20, the second thrust portion 41 of the pushing member 40 abut the second feeder 30, and the cutting blades 43 of the pushing member 40 abut the separation plate 12 of the container 10. The container 10 is placed in a caulking gun. When the caulking gun is started, the piston release of the caulking gun gradually pushes the pushing member 40 to move the pushing member 40 in the container 10. In such a manner, the first thrust portions 42 of the pushing member 40 pushes the first feeder 20 to compress the main sealant, and the second thrust portion 41 of the pushing member 40 pushes the second feeder 30 to compress the secondary sealant, so that the main sealant and the secondary sealant are compressed toward and squeezed outward from the spout 11 of the container 10. At the same time, the cutting blades 43 of the pushing member 40 cut the separation plate 12 of the container 10 to allow the pushing member 40 to move forward.

Accordingly, the container 10 is directly placed into a caulking gun so that the user can use the double-sealant tube structure easily and conveniently. In addition, the main sealant and the secondary sealant are separated exactly during storage and usage.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A double-sealant tube structure comprising:

a container, a first feeder, a second feeder, and a pushing member, wherein:

the container has an end provided with a spout;

the spout of the container has an interior provided with a dividing plate;

the container has an interior provided with a separation plate;

the first feeder is mounted in the main space of the container;

the second feeder is mounted in the secondary space of the container;

the pushing member is provided with two first thrust portions corresponding to the first feeder and a second thrust portion corresponding to the second feeder;

the pushing member is further provided with two cutting blades each located between one of the two first thrust portions and the second thrust portion;

each of the cutting blades of the pushing member is perpendicular to and intersects the separation plate of the container;

the pushing member is further provided with an arcuate pressing edge to press the separation plate toward an inner wall of the container when the separation plate is cut by the cutting blades of the pushing member;

when the pushing member pushes the first feeder and the second feeder, the separation plate is cut by the cutting blades to allow the pushing member to move forward.

2. The double-sealant tube structure for a caulking gun of claim 1, wherein the container has a size the same as that of a one-sealant tube.

3. The double-sealant tube structure for a caulking gun of claim 1, wherein an annular rib is formed on an outer periphery of the first feeder and the second feeder.

4. The double-sealant tube structure for a caulking gun of claim 1, wherein the separation plate of the container extends from the dividing plate of the spout to an open end of the container.

5. The double-sealant tube structure for a caulking gun of claim 1, wherein the first feeder has a cross-sectional shape corresponding to that of an inner wall of the main space, and the second feeder is juxtaposed to the first feeder and has a cross-sectional shape corresponding to that of an inner wall of the secondary space.

* * * * *